US011298573B2

(12) United States Patent
van der Stokker

(10) Patent No.: US 11,298,573 B2
(45) Date of Patent: Apr. 12, 2022

(54) EXTENDED DISCHARGE FIRE SUPPRESSION SYSTEMS AND METHODS

(71) Applicant: ETG FIRE, Inc., Denver, CO (US)

(72) Inventor: Chris van der Stokker, Denver, CO (US)

(73) Assignee: ETG Fire, Inc., Denver, CO (US)

( * ) Notice: Subject to any disclaimer, the term of this patent is extended or adjusted under 35 U.S.C. 154(b) by 0 days.

(21) Appl. No.: 16/942,879

(22) Filed: Jul. 30, 2020

(65) Prior Publication Data

US 2021/0031063 A1 Feb. 4, 2021

Related U.S. Application Data

(60) Provisional application No. 62/881,971, filed on Aug. 2, 2019.

(51) Int. Cl.

| | |
|---|---|
| ***A62C 35/02*** | (2006.01) |
| ***A62C 3/08*** | (2006.01) |
| ***A62D 1/00*** | (2006.01) |
| ***A62C 31/02*** | (2006.01) |
| ***A62C 35/68*** | (2006.01) |
| ***A62C 3/06*** | (2006.01) |

(52) U.S. Cl.

CPC ..... *A62C 35/023* (2013.01); *A62C 3/06* (2013.01); *A62C 3/08* (2013.01); *A62C 31/02* (2013.01); *A62C 35/68* (2013.01); *A62D 1/0028* (2013.01)

(58) Field of Classification Search

CPC ..... A62C 35/023; A62C 3/06; A62C 3/08; A62C 31/02; A62C 35/68; A62D 1/0028

USPC ..... 169/9, 16

See application file for complete search history.

(56) References Cited

U.S. PATENT DOCUMENTS

| | | | | |
|---|---|---|---|---|
| 2,933,139 | A | 4/1960 | William | |
| 4,643,260 | A | 2/1987 | Miller | |
| 5,183,116 | A | 2/1993 | Fleming | |
| 6,478,979 | B1 | 11/2002 | Rivers et al. | |
| 6,763,894 | B2 | 7/2004 | Schoenrock et al. | |
| 6,935,433 | B2 | 8/2005 | Gupta | |
| 7,389,824 | B2 | 6/2008 | Jackson | |
| 8,915,307 | B2 | 12/2014 | Lelic et al. | |
| 9,016,392 | B2 * | 4/2015 | Khalil | A62C 35/58 169/15 |
| 2003/0089877 | A1 | 5/2003 | Rivers et al. | |
| 2005/0001065 | A1 | 1/2005 | Senecal | |

(Continued)

FOREIGN PATENT DOCUMENTS

| | | | |
|---|---|---|---|
| CN | 101567027 | A | 10/2009 |
| WO | 1989003554 | A1 | 4/1989 |

OTHER PUBLICATIONS

Inergen Clean Agent Fire Suppression System, www.monroeextinguisher.com/inergen-clean-agent-fire-suppression-system/, accessed Mar. 9, 2019.

(Continued)

*Primary Examiner* — Christopher S Kim

(74) *Attorney, Agent, or Firm* — Elevated IP, LLC

(57) ABSTRACT

The present disclosure generally relates to systems and methods for extinguishing and/or suppressing fire in a structure. Particularly, the present systems and methods discharge clean agents over an extended period of time at an occupiable level to protect life, reduce personnel training time and expense, and preserve valuable items.

15 Claims, 4 Drawing Sheets

(56) References Cited

U.S. PATENT DOCUMENTS

| | | | |
|---|---|---|---|
| 2008/0224877 | A1 | 9/2008 | Young |
| 2009/0014187 | A1 | 1/2009 | Wagner |

OTHER PUBLICATIONS

International Search Report and Written Opinion for corresponding PCT/US20/44136, dated Nov. 4, 2020.

* cited by examiner

EXTENDED DISCHARGE FIRE SUPPRESSION SYSTEMS AND METHODS

CROSS-REFERENCE TO RELATED APPLICATIONS

This application claims the benefit of and priority to U.S. Provisional Patent Appl. No. 62/881,971, filed Aug. 2, 2019, which is hereby incorporated by reference in its entirety.

STATEMENT REGARDING FEDERALLY SPONSORED RESEARCH

None.

BACKGROUND

Fire suppression systems releasing non-aqueous chemicals called "clean agents", rather than water, have been used to protect valuable items (e.g., server centers, museum contents, document archives, etc.). These systems generally contain a rapid discharge unit that releases a clean agent in less than 10 seconds to extinguish a fire, and in rare cases, the rapid discharge unit is backed-up by an extended discharge system that maintains a sufficient concentration of clean agent for several minutes to prevent the fire from reigniting prior to the arrival of firefighting personnel and resources.

Although clean agents have evolved, the infrastructure for discharging the clean agents has remained largely stagnant. For example, many early clean agents contributed to ozone depletion and were banned. In their place, inert gases were employed to smother fires, but these systems required massive storage space and extensive training for people working in potential discharge areas with little time to escape or switch to supplemental oxygen. Newer clean agents, that would otherwise be stored as liquids, are often mixed in a single tank with an inert gas to make use of existing gas deployment infrastructure. However, diluting the clean agent in this manner maintains the drawbacks of inert gas systems, and the present inventor is unaware of systems or methods addressing the challenges of delivering a liquid clean agent via an extended discharge fire suppression system.

Some existing clean agent systems and methods are described, for example, in U.S. Pat. Nos. 4,643,260, 5,183,116, 6,478,979, 6,763,894 and the Inergen Clean Agent Fire Suppression System.

SUMMARY

The present disclosure generally relates to systems and methods for extinguishing and/or suppressing fire in a structure. Particularly, the present systems and methods discharge clean agents over an extended period of time at an occupiable level to protect life, reduce personnel training time and expense, and preserve valuable items.

In an aspect, an extended discharge fire suppression system for a structure comprises an agent tank containing a fire suppressant in a liquefied state; a propellant tank in series with the agent tank, the propellant tank storing a propellant gas separate from the fire suppressant; a regulator between the agent tank and the propellant tank for delivering a predetermined pressure of propellant gas to the agent tank; at least one nozzle located in the structure; a pipe network for communicating a mixture of the fire suppressant and the propellant gas to the at least one nozzle; an orifice plate, inline with the pipe network between the agent tank and the at least one nozzle, for controlling a flow rate of the mixture to the at least one nozzle; and a valve having an open state allowing flow through the pipe network and a closed state preventing flow through the pipe network.

In an embodiment, at least a portion of a fire suppressant passes through the orifice plate as a liquid. In an embodiment, a majority of a fire suppressant passes through the orifice plate as a liquid. In an embodiment, at least 50%, or at least 75%, or at least 80%, or at least 85% of the fire suppressant passes through the orifice plate as a liquid.

In an embodiment, a mixture of fire suppressant and propellant gas is delivered to at least one nozzle for at least 10 minutes, or at least 30 minutes, or at least 60 minutes. In an embodiment, a mixture of fire suppressant and propellant gas is delivered to at least one nozzle for between 10 minutes and 3 hours, or between 15 minutes and 2.5 hours, or between 30 minutes and 2 hours, or between 45 minutes and 1.5 hours.

In an embodiment, a concentration of the fire suppressant in the structure is maintained between 5 mole percent and 10 mole percent for between 10 minutes and 3 hours, or between 15 minutes and 2.5 hours, or between 30 minutes and 2 hours, or between 45 minutes and 1.5 hours. In an embodiment, an occupiable concentration window of the fire suppressant is between 4.7 mole percent and 10 mole percent, or between 4.7 mole percent and 7 mole percent.

In an embodiment, the fire suppressant is delivered to the structure at a flow rate between 1.5 pounds per minute and 30 pounds per minute, or between 1.55 pounds per minute and 20 pounds per minute, or between 1.6 pounds per minute and 10 pounds per minute.

In an embodiment, fire suppressant is expelled from at least one nozzle in a vapor state at a pressure between 30 psig and 65 psig.

In an embodiment, the fire suppressant is a clean agent. In an embodiment, the clean agent is a halogenated ketone. For example, the halogenated ketone may be a fluorinate ketone selected from the group consisting of $CF_3CF_2C(O)CF(CF_3)_2$, $(CF_3)_2CFC(O)CF(CF_3)_2$, $CF_3(CF_2)_2C(O)CF(CF_3)_2$, $CF_3(CF_2)_3C(O)CF(CF_3)_2$, $CF_3(CF_2)_5C(O)CF_3$, $CF_3CF_2C(O)CF_2CF_2CF_3$, $CF_3C(O)CF(CF_3)_2$, perfluorocyclohexanone, and mixtures thereof. In an embodiment, the fluorinated ketone is $C_2F_5C(O)CF(CF_3)_2$.

In an embodiment, the propellant is selected from the group consisting of nitrogen, argon, helium, xenon, neon, carbon dioxide and combinations thereof. In an embodiment, the propellant is nitrogen.

In an embodiment, the propellant is delivered to the agent tank at a pressure between 200 psi and 800 psi, or between 300 psi and 600 psi, or between 350 psi and 400 psi.

In an embodiment, at least one nozzle of an extended discharge fire suppression system and/or a rapid discharge fire suppression system is an aspirating nozzle or a non-aspirating nozzle. In an embodiment, an extended discharge fire suppression system and/or a rapid discharge fire suppression system comprises a mixture of aspirating and non-aspirating nozzles.

In an embodiment, a nozzle comprises a plurality of orifices each having a diameter between 1/64 inch and 1/4 inch, or between 1/64 inch and 1/8 inch. In an embodiment, an orifice plate comprises a plurality of orifices each having a diameter ranging from 0.01 inches to 0.5 inches, or from 0.02 inches to 0.04 inches, or from 0.025 inches to 0.035 inches. In an embodiment, a ratio of the open area within the nozzle to the open area within the orifice plate is between 2 and 10, or between 3 and 9, or between 4 and 8.

In an embodiment, a structure has a leakage rate greater than or equal to 5% of the volume of the structure per minute.

In an embodiment, a structure protected by an extended discharge fire suppression system is a power generation facility, a data center, an airplane, a museum, or a chemical facility. Particularly, structures where water would damage the structure contents or chemically react with contents to create an environmental or physiological hazard may be protected by an extended discharge fire suppression system as disclosed herein.

In an aspect, a fire suppression system comprises an extended discharge fire suppression system as disclosed herein and a rapid discharge fire suppression system comprising a second agent tank containing an additional fire suppressant. In an embodiment, a rapid discharge fire suppression system further comprises a second propellant tank in series with the second agent tank, the second propellant tank storing an additional propellant gas separate from the additional fire suppressant. In an embodiment, the rapid discharge fire suppression system further comprises at least one second nozzle located in the structure and a second pipe network for communicating the additional fire suppressant to the at least one second nozzle. In an embodiment, the additional fire suppressant is the same compound as the fire suppressant of the extended discharge fire suppression system. In an embodiment, the additional fire suppressant is delivered to the structure in 10 seconds or less to achieve a predetermined concentration of the additional fire suppressant sufficient to extinguish a fire in the structure.

In an aspect, a method of suppressing fire within a structure comprises passing a propellant gas, stored in a propellant tank separate from a fire suppressant in an agent tank, through a regulator at a predetermined pressure into the agent tank; providing a pipe network for communicating a mixture of the fire suppressant and the propellant gas to at least one nozzle located in the structure; and controlling a flow rate of the mixture to the at least one nozzle using an orifice plate inline with the pipe network between the agent tank and the at least one nozzle.

In an embodiment, a method of suppressing fire within a structure further comprises rapidly discharging an additional fire suppressant from a second agent tank. In an embodiment, the additional fire suppressant is propelled by an additional propellant gas. In an embodiment, the additional fire suppressant is dispersed through at least one second nozzle, located in the structure, and a second pipe network for communicating the additional fire suppressant to the at least one second nozzle.

BRIEF DESCRIPTION OF THE DRAWINGS

Illustrative embodiments of the present invention are described in detail below with reference to the attached drawings, wherein.

DETAILED DESCRIPTION

In general, the terms and phrases used herein have their art-recognized meaning, which can be found by reference to standard texts, journal references and contexts known to those skilled in the art. The following definitions are provided to clarify their specific use in the context of this description.

As used herein, the term "clean agent" refers to a non-aqueous chemical capable of extinguishing and/or suppressing an exothermic reaction.

As used herein, the terms "occupiable level" and "occupiable concentration" refer to a maximum amount of clean agent present within a specified area (concentration) that would sustain human life.

Figure 1:
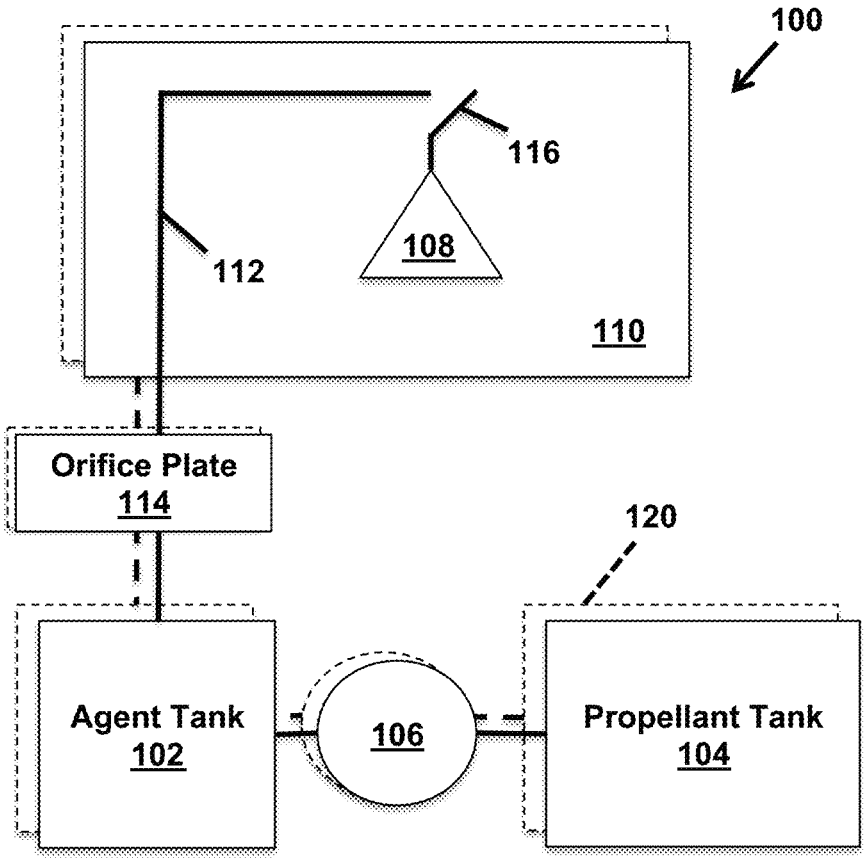
FIG. 1 is a block diagram of an extended discharge fire suppression system, according to multiple embodiments.

FIG. 1 is a block diagram of an exemplary extended discharge fire suppression system 100 for a structure 110. As shown, an agent tank 102 containing a fire suppressant in a liquefied state and a propellant tank 104 storing a propellant gas are stored outside structure 110. Alternatively, all components of an extended discharge fire suppression system 100 may be stored within structure 110. Propellant tank 104 is connected in series with agent tank 102 by a gas line and a regulator 106. A pipe network 112 for communicating a mixture of the fire suppressant and the propellant gas contains an inline orifice plate 114 and terminates at a nozzle 108 located in structure 110. A valve 116, which may be triggered by heat or smoke, has a closed state that permits flow through the pipe network when smoke or heat is detected and an open state preventing flow through the pipe network at all other times. In some embodiments, a rapid discharge fire suppression system 120 may be present for use with the extended discharge fire suppression system 100. The rapid discharge fire suppression system 120 optionally includes a second agent tank containing an additional fire suppressant, a second propellant tank in series with the second agent tank, at least one second nozzle located in the structure and/or a second pipe network for communicating the additional fire suppressant to the at least one second nozzle.

Figure 2:
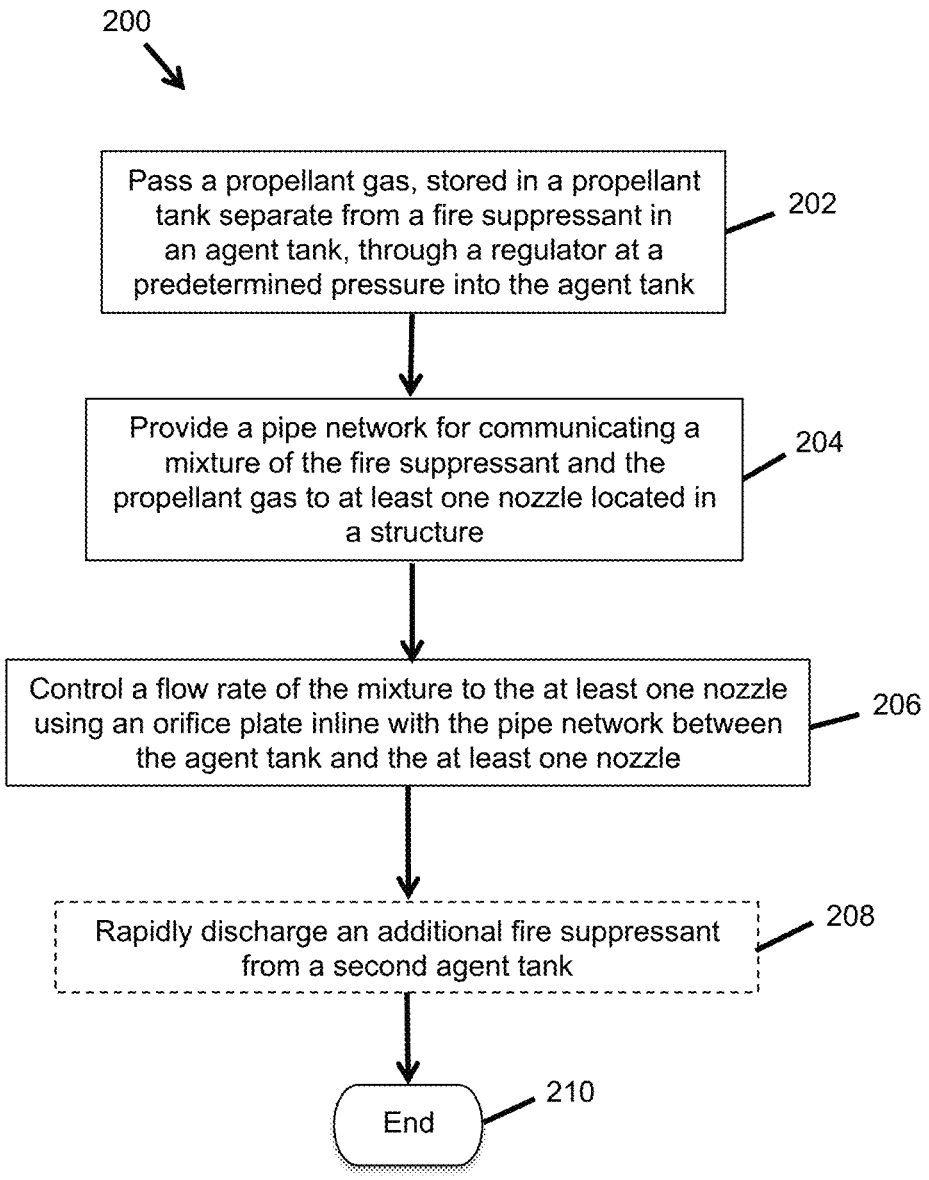
FIG. 2 is a flowchart illustrating steps in a method of suppressing fire within a structure, according to multiple embodiments.

FIG. 2 is a flowchart 200 illustrating steps in a method of suppressing fire within a structure. In step 202, a propellant gas, stored in a propellant tank separate from a fire suppressant in an agent tank, is passed through a regulator at a predetermined pressure into the agent tank. In step 204, a pipe network for communicating a mixture of the fire suppressant and the propellant gas to at least one nozzle located in a structure is provided. In step 206, a flow rate of the mixture to the at least one nozzle is controlled using an orifice plate inline with the pipe network between the agent tank and the at least one nozzle. Optional step 208 comprises rapidly discharging an additional fire suppressant from a second agent tank, and the method ends with step 210. Those of skill in the art will appreciate that these steps may be performed in any order, but typically step 208 (if present) is performed first to rapidly extinguish an active fire followed by extended discharge of a fire suppressant to keep the fire extinguished until first responders arrive.

Figure 3:
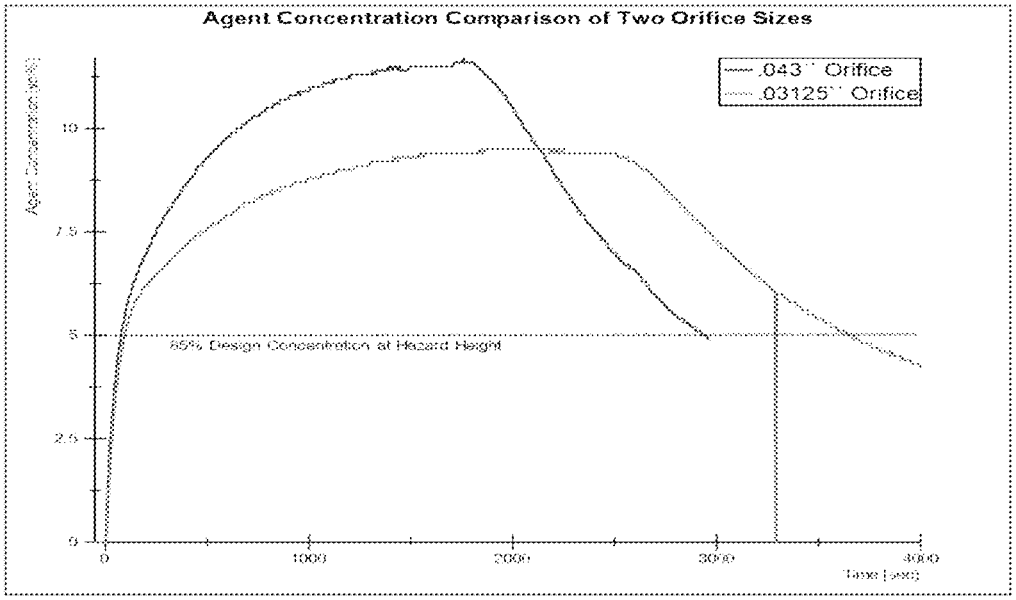
FIG. 3 is a graph of clean agent concentration versus time for two orifice plates with different sized orifices.

FIG. 3 is a graph of clean agent concentration versus time for two orifice plates with different sized orifices illustrating that higher concentrations of clean agent are achievable with a larger orifice diameter, but for a shorter duration.

Figure 4:
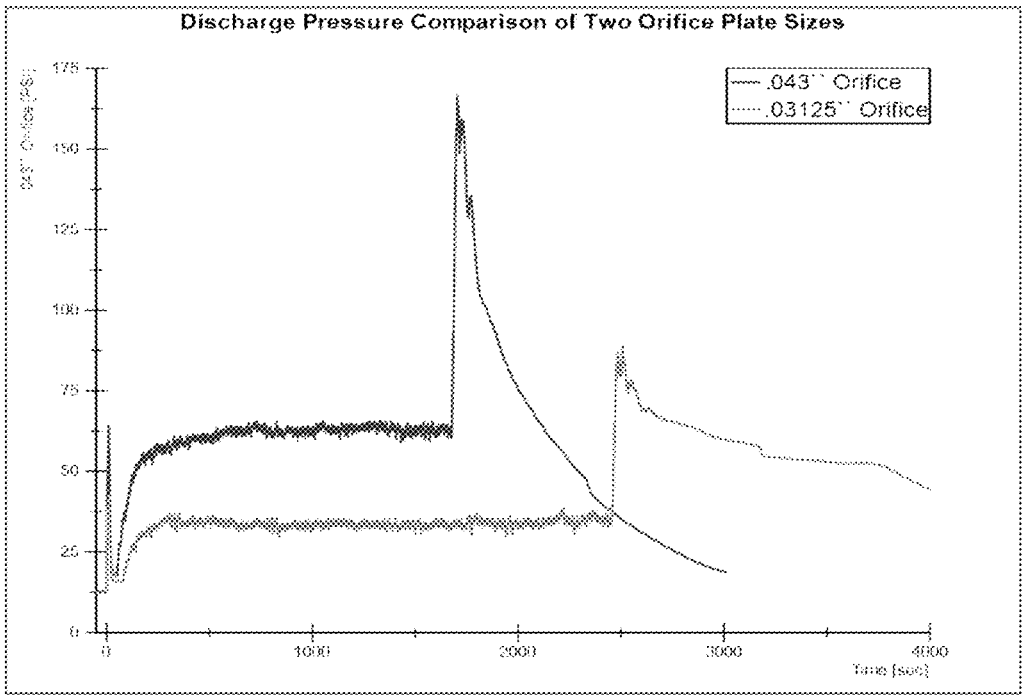
FIG. 4 is a graph of clean agent discharge pressure versus time for two orifice plates with different sized orifices.

FIG. 4 is a graph of clean agent discharge pressure versus time for two orifice plates with different sized orifices illustrating that clean agent is depleted faster in the case of the larger orifice diameter. Depletion is signaled by a propellant gas blow-off spike.

Figure 5:
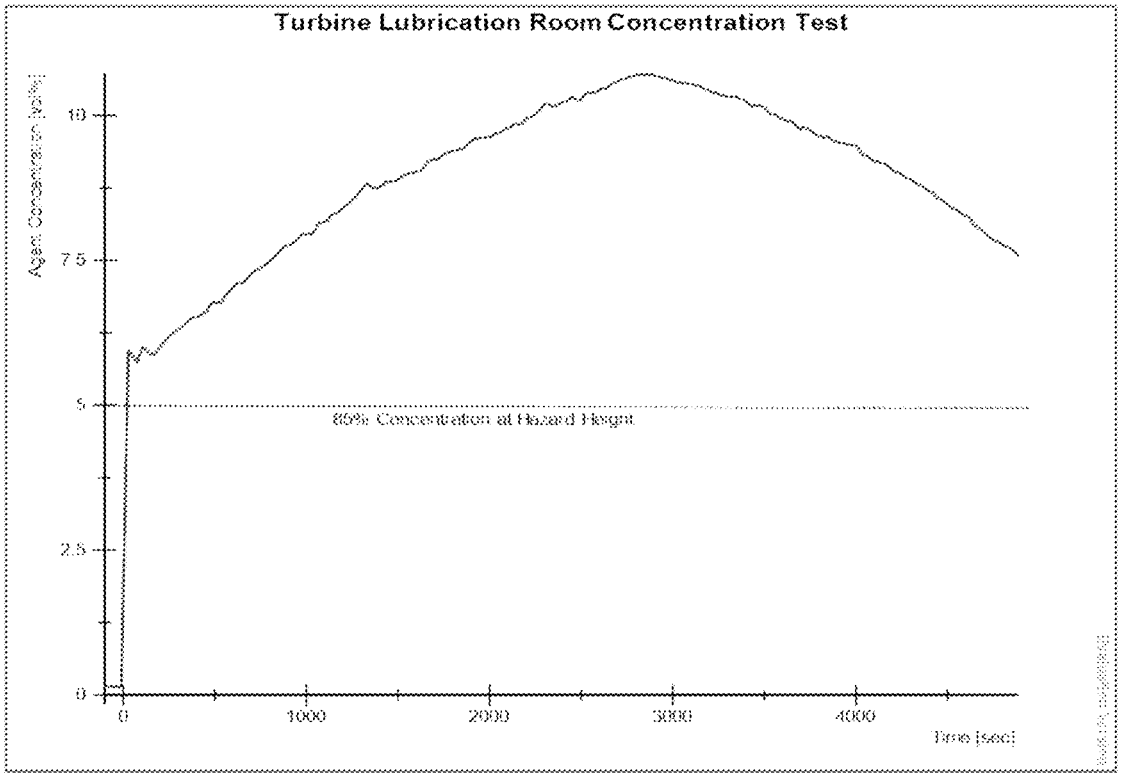
FIG. 5 is a graph of clean agent concentration versus time during testing of an exemplary extended discharge fire suppression system.

FIG. 5 is a graph of clean agent concentration versus time during testing of an exemplary extended discharge fire suppression system illustrating maintenance of a clean agent concentration sufficient to suppress fire for at least 5000 seconds (83 minutes).

The systems and methods disclosed herein are further illustrated by the following Example. This Example is for illustrative purposes only and is not intended to limit the invention.

Example

This Example describes the testing of an exemplary extended discharge fire suppression system for protection of a turbine facility of a power generation plant.

Once the system components were optimized, two full scale tests were conducted in the enclosure using two different orifice plates to demonstrate that the system can be designed to account for varying leakage rates. Two systems were used for these tests, one a traditional clean agent system with a 10 second discharge to bring the room to the design concentration and an extended discharge system to maintain the design concentration for the designed hold time. The room concentration for both tests can be seen in FIG. 3 and the nozzle pressures can be seen in FIG. 4.

System data can be seen in Table 1. It was critical to maintain a constant pressure on the orifice plate to ensure a consistent nozzle pressure and flow rate. This was done by installing a high-pressure regulator between the agent cylinder and nitrogen booster tank that was set at a predetermined pressure. The extended discharge time was determined by a pressure spike that signaled the agent cylinder had been depleted (see FIG. 4).

TABLE 1

| Orifice Diameter [in] | Initial Discharge Agent Weight [lbs] | Extended Discharge Agent Weight [lbs] | Nozzle to Orifice Area Ratio | Mean Nozzle Pressure [psig] | Discharge Time [sec] | Concentration Max [vol %] | Hold Time [sec] |
|---|---|---|---|---|---|---|---|
| 0.03125 | 47 | 200 | 8.0001 | 33.9 | 2454 | 9.5 | 3680 |
| 0.043 | 47 | 200 | 4.2253 | 65.5 | 1678 | 11.7 | 2960 |

Instrumentation

A National Instruments cDAQ 9174 CompactDAQ was used to collect pressure, temperature and concentration measurements. An NI-9213 module was used to collect temperature readings from Type K thermocouples. An NI-9219 module was used to collect pressure and concentration measurements. Two types of pressure transducers were used: a 0-500 psig Omega PX102 0-100 mV flush diaphragm pressure transducer for monitoring the pre-orifice plate pressure and a 0-100 psia Omega PX429-100AV pressure transducer for monitoring the nozzle pressure. Only the nozzle pressure was able to be recorded during the full-scale test.

Agent concentration was determined using a modified Tripoint Perco Model 113 Dual Gas Analyzer. The instrument was wired to output a voltage signal that was recorded by the data acquisition system at a rate of 0.20 Hz. The meter was calibrated before use using an Airgas calibration standard with a concentration of 5.99 mol %. After each test the meter was again calibrated to account for any creep that may have occurred during the test.

Development Testing

An 892.5 $ft^3$ structure was constructed to represent a scaled version of the turbine lubricant pump room. Penetrations were made throughout the structure so that the room leakage rate matched the actual lubricant pump room based on door fan tests conducted in accordance with NFPA 2001 Annex C.

Prior to conducting the full-scale tests, several small-scale tests were conducted. Different nozzle designs were evaluated, and a custom nozzle was developed that was superior in its ability to aspirate and disperse the agent. It is important that the nozzle orifice area stay consistent throughout designs for system simplicity and not affect the flow rate for an individual system. Several orifice plates were evaluated, and flow rates based on orifice size were confirmed over multiple tests to ensure consistency in delivery of the agent.

Full Scale Concentration Test

Alarm and Notification

Tech Electronics of Colorado installed a Notifier NFS2-3030 control panel with an integrated voice evacuation system with the ability to select up to 3,000 different messages or up to 32 minutes of continuous play time. This was done with the intent that anyone working around the generator would understand the sequence of the suppression system without having to be trained on tones and pulse rates of the horn signals or re-trained on an annual basis to maintain their understanding of the system tones. Any function in the system could be assigned a custom message that would provide direction and clarification to individuals working in and around the generator. With a specific message associated with each function being played it is easier for operators onsite to make intelligent decisions to intervene or evacuate the space.

System Design

A full-scale discharge test was conducted at the utilities facility for the turbine lubrication pump room. Agent concentration was taken at the highest hazard level. The room concentration for the test can be seen in FIG. 5.

After ninety minutes the test was stopped by the utility prior to the room concentration reaching 85% of the design concentration at the height of the hazard. The test exceeded their required hold time and the lubricating pumps needed to be reactivated to ensure no damage to the turbine bearing. Test data can be seen in FIG. 5 and Table 2. The estimated hold time was determined by assuming a constant agent depletion rate.

TABLE 2

| Orifice Diameter [in] | Initial Discharge Agent Weight [lbs] | Extended Discharge Agent Weight [lbs] | Nozzle to Orifice Area Ratio | Discharge Time [sec] | Concentration Max [vol %] | Estimated Hold Time [sec] |
|---|---|---|---|---|---|---|
| 0.03125 | 100 | 180 | 8.0001 | 2885 | 10.7 | 6985 |

STATEMENTS REGARDING INCORPORATION BY REFERENCE AND VARIATIONS

All references cited throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods, software and apparatus/devices can include a large number of optional elements and steps. All art-known functional equivalents of materials and methods are intended to be included in this disclosure. Nothing herein is to be construed as an admission that the invention is not entitled to antedate such disclosure by virtue of prior invention.

When a group of substituents is disclosed herein, it is understood that all individual members of that group and all subgroups are disclosed separately. When a Markush group or other grouping is used herein, all individual members of the group and all combinations and subcombinations possible of the group are intended to be individually included in the disclosure.

It must be noted that as used herein and in the appended claims, the singular forms "a", "an", and "the" include plural reference unless the context clearly dictates otherwise. Thus, for example, reference to "a pipe" includes a plurality of such pipes and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements, limitation or limitations which is/are not specifically disclosed herein.

What is claimed is:

1. An extended discharge fire suppression system for a structure, comprising:

an agent tank containing a fire suppressant in a liquefied state, wherein the fire suppressant comprises a clean agent;

a propellant tank connected in series with the agent tank, the propellant tank storing a propellant gas separate from the fire suppressant;

a regulator between the agent tank and the propellant tank for delivering a predetermined pressure of the propellant gas to the agent tank to create a mixture of the fire suppressant and the propellant gas;

at least one nozzle located in the structure;

a pipe network for fluidly communicating the mixture of the fire suppressant and the propellant gas to the at least one nozzle;

an orifice plate, inline with the pipe network between the agent tank and the at least one nozzle, for controlling a flow rate of the mixture to the at least one nozzle; and a valve having an open state allowing flow through the pipe network and a closed state preventing the flow through the pipe network;

wherein the extended discharge fire suppression system is configured to deliver the mixture to the structure for between 10 minutes and 3 hours without exceeding an occupiable concentration.

2. The extended discharge fire suppression system of claim 1, wherein at least a portion of the fire suppressant passes through the orifice plate as a liquid.

3. The extended discharge fire suppression system of claim 1, wherein the occupiable concentration of the fire suppressant in the structure is maintained between 5 mole percent and 10 mole percent for between 10 minutes and 3 hours.

4. The extended discharge fire suppression system of claim 1, wherein the clean agent is a halogenated ketone.

5. The extended discharge fire suppression system of claim 4, wherein the halogenated ketone is a fluorinate ketone selected from the group consisting of $CF_3CF_2C(O)CF(CF_3)_2$, $(CF_3)_2CFC(O)CF(CF_3)_2$, $CF_3(CF_2)_2C(O)CF(CF_3)_2$, $CF_3(CF_2)_3C(O)CF(CF_3)_2$, $CF_3(CF_2)_5C(O)CF_3$, $CF_3CF_2C(O)CF_2CF_2CF_3$, $CF_3C(O)CF(CF_3)_2$, Perfluorocyclohexanone, and mixtures thereof.

6. The extended discharge fire suppression system of claim 1, wherein the at least one nozzle is an aspirating nozzle.

7. The extended discharge fire suppression system of claim 1, wherein a ratio of open area within the nozzle to open area within the orifice plate is between 2 and 10.

8. The extended discharge fire suppression system of claim 1, wherein the structure has a leakage rate greater than or equal to 5% of the volume of the structure per minute.

9. The extended discharge fire suppression system of claim 1, wherein the structure is a power generation facility, a data center, an airplane, a museum or a chemical facility.

10. A fire suppression system comprising:

the extended discharge fire suppression system of claim 1; and a rapid discharge fire suppression system comprising a second agent tank containing an additional fire suppressant.

11. The fire suppression system of claim 10, wherein the rapid discharge fire suppression system further comprises a second propellant tank in series with the second agent tank, the second propellant tank storing an additional propellant gas separate from the additional fire suppressant.

12. The fire suppression system of claim 10, wherein the rapid discharge fire suppression system further comprises at least one second nozzle located in the structure and a second pipe network for communicating the additional fire suppressant to the at least one second nozzle.

13. The fire suppression system of claim 10, wherein the additional fire suppressant is the same compound as the fire suppressant of the extended discharge fire suppression system.

14. The fire suppression system of claim 10, wherein the additional fire suppressant is delivered to the structure in 10 seconds or less to achieve a predetermined concentration of the additional fire suppressant sufficient to extinguish a fire in the structure.

15. The extended discharge fire suppression system of claim 1, wherein the at least one nozzle is a non-aspirating nozzle.

* * * * *